US006679783B1

(12) United States Patent
Lin

(10) Patent No.: US 6,679,783 B1
(45) Date of Patent: Jan. 20, 2004

(54) GOLF TRAINING DEVICE

(76) Inventor: Chung-Ming Lin, 6F, No. 613, Ming-Shwei Rd., Taipei (TW)

( * ) Notice: Subject to any disclaimer, the term of this patent is extended or adjusted under 35 U.S.C. 154(b) by 0 days.

(21) Appl. No.: 10/211,459

(22) Filed: Aug. 5, 2002

(51) Int. Cl.[7] ..... A63B 53/06; A63B 53/16; A63B 69/36

(52) U.S. Cl. ..... 473/257

(58) Field of Search ..... 473/257, 261, 473/262, 267, 266, 268, 278, 279, 240

(56) References Cited

U.S. PATENT DOCUMENTS 1,612,291 A * 12/1926 Jackson ..... 473/160
1,759,156 A * 5/1930 Fish ..... 473/143
2,144,439 A * 1/1939 Duffy ..... 473/160
2,869,875 A * 1/1959 Steenson ..... 473/170
3,424,463 A * 1/1969 Matthews ..... 473/163
3,526,405 A * 9/1970 Morris ..... 473/191
3,584,877 A * 6/1971 Florian ..... 473/159
3,604,711 A * 9/1971 Hansburg ..... 473/257
3,685,833 A * 8/1972 Jack, Jr. ..... 473/151
3,762,718 A * 10/1973 Culley ..... 473/160
3,806,133 A * 4/1974 Cork ..... 473/258
3,843,136 A * 10/1974 Buenzle ..... 473/162
3,869,128 A * 3/1975 Ohashi ..... 473/278
3,934,874 A * 1/1976 Henderson ..... 473/265
4,783,075 A * 11/1988 Simjian ..... 473/159
4,805,912 A * 2/1989 Hickman ..... 473/159
4,828,267 A * 5/1989 Goodrich ..... 473/160
5,042,815 A * 8/1991 Sutton ..... 473/218
5,102,141 A * 4/1992 Jordan ..... 473/163
5,209,484 A * 5/1993 Randall ..... 473/265
5,294,124 A * 3/1994 Florian ..... 473/267
5,431,403 A * 7/1995 Pelz ..... 473/160
5,630,719 A * 5/1997 Franklin ..... 434/252
5,692,967 A * 12/1997 Guyer ..... 473/262
5,913,732 A * 6/1999 Kwakkel ..... 473/267
6,048,273 A * 4/2000 Clement ..... 473/261

* cited by examiner

*Primary Examiner*—Paul T. Sewell
*Assistant Examiner*—Nini F. Legesse
(74) *Attorney, Agent, or Firm*—Birch, Stewart, Kolasch & Birch, LLP

(57) ABSTRACT

A golf training device includes a putting green platform having an incline extending from a lower end to an upper end forming a recess that a golf ball is destined for. A wall surrounds the incline of the platform for stopping movement of improperly hit golf balls. A tee base is spaced from the putting green platform and has a top surface. A runway is arranged between the tee base and the lower end of the incline of the putting green platform. A correction device includes a correction wire located above and extending from the base, through and substantially parallel to the runway, to the platform for forming an indication between the tee base and the recess of the platform. A mirror is attached to the top surface of the base for providing visual feedback to a player when the player is swinging a putter to hit a golf ball into the recess.

16 Claims, 5 Drawing Sheets

GOLF TRAINING DEVICE

FIELD OF THE INVENTION

The present invention relates generally to a golf training device, and in particular to a golf training device having a player's attitude correcting device.

BACKGROUND OF THE INVENTION

A golf training device simulates a putting green of a golf course. A player may practice putting operation without actually playing in a real golf course. A conventional golf training device comprises a runway for golf balls and a putting green platform which forms a hole for receiving the golf ball moving through the runway. The overall structure of the conventional golf training device is simple and can be made portable whereby a player can practice putting at any desired location.

The conventional golf training device, however, provides a simulation of the putting green that allows a player to repeatedly practice putting only. There is no measure that a player can get feedback from the device regarding if his or her attitude is correct or not or how to correct his or her attitude.

Thus, it desired to improve the golf training device to provide a better solution of practicing golf.

SUMMARY OF THE INVENTION

An object of the present invention is to provide a golf training device comprising a player's attitude correcting device.

Another object of the present invention is to provide a golf training device comprising a correction wire for indicating the movement direction of a putted golf ball along the runway to allow a player to observe and get a visual feedback of his or her putting operation. The player may then modify his or her attitude in putting a ball based on the observation. The correction wire also helps the player to correct and improve his or her visual determination of the location and orientation of the ball hole in the putting green.

A further object of the present invention is to provide a golf training device comprising a correction mirror which reflects and shows the image of a player when the player is putting a ball whereby the player can modify his or her attitude to get a good putting.

Yet a further object of the present invention is to provide a golf training device that allows for automatic return of putted balls.

Further scope of the applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will be apparent to those skilled in the art by reading the following description of a preferred embodiment thereof, with reference to the attached drawings, which are given by way of illustration only, and thus are not limitative of the present invention, and in which.

DETAILED DESCRIPTION OF THE INVENTION

Figure 1:
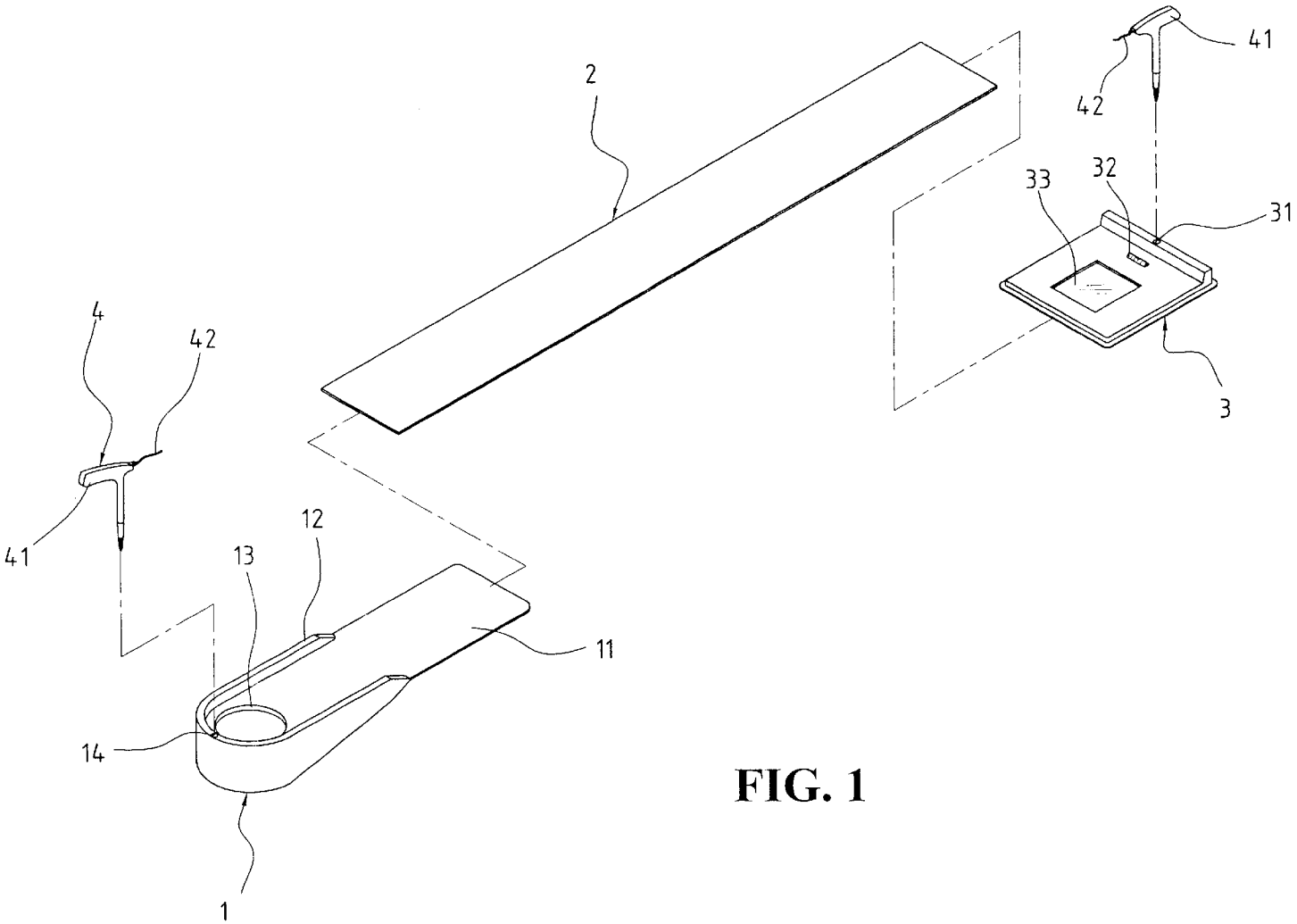
FIG. 1 is an exploded view of a golf training device constructed in accordance with the present invention.
Figure 2:
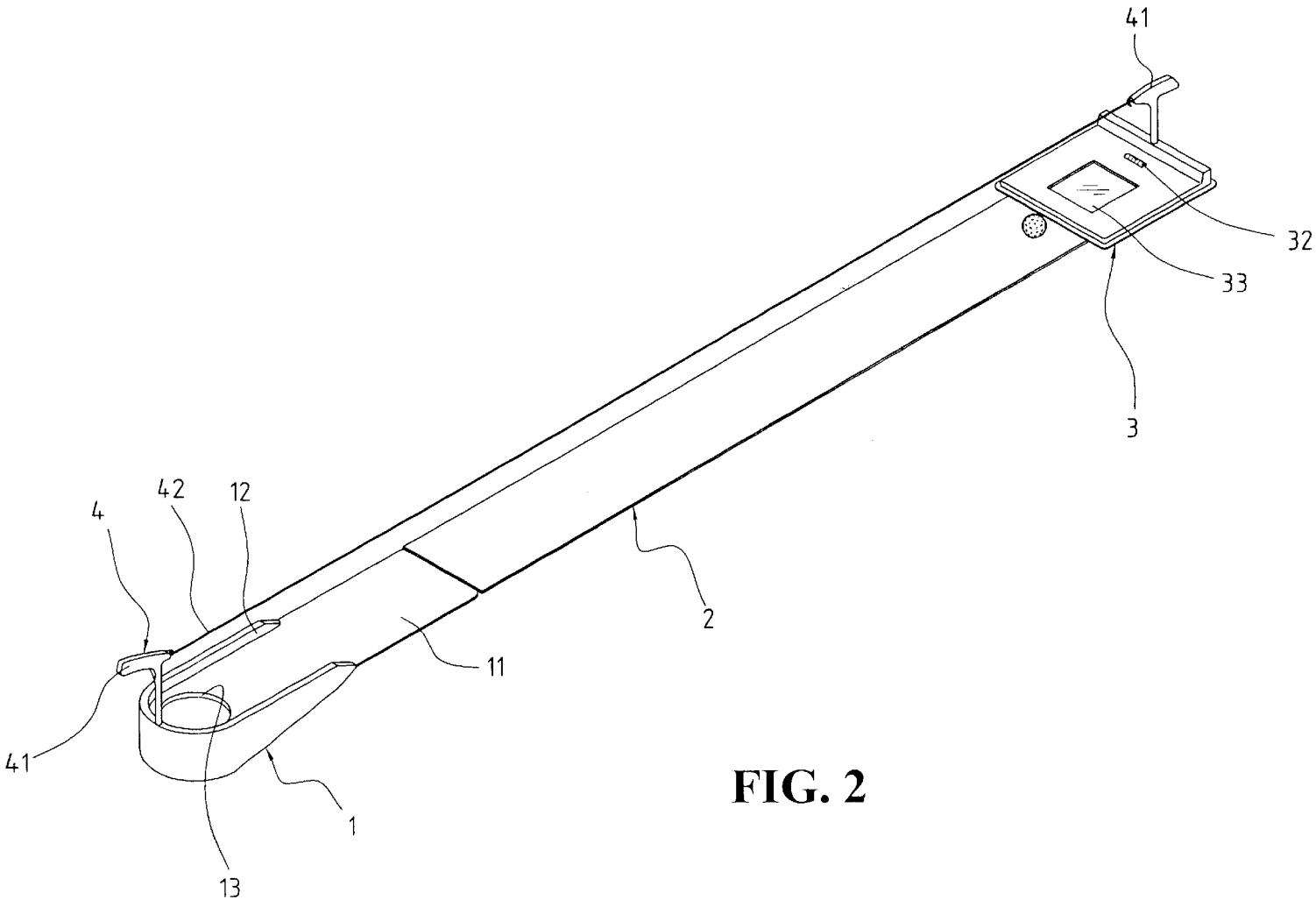
FIG. 2 is a perspective view of the golf training device of the present invention.

With reference to the drawings and in particular to FIGS. 1 and 2, a golf training device constructed in accordance with the present invention comprises a putting green platform 1 and a tee base 3 with an elongate runway 2 connected between the platform 1 and the base 3. The platform 1 comprises an incline 11 extending from a lower end that is connected to a remote end of the runway 2 to an rounded upper, apex portion in which a circular recess 13 is defined. A U-shaped wall 12 surrounds the apex portion. The wall 12 extends beyond the top surface of the incline 11 for blocking golf balls.

The tee base 3 comprises a board of a predetermined thickness having a top surface (not labeled) on which a level 32 is mounted for helping to level the tee base 3. The golf training device further comprises a correcting device 4 comprising a correction mirror 33 mounted on the top surface of the tee base 3 and a correction wire 42 straightly extending between the tee base 3 and the platform 1. An anchoring member 41 fixes an end of the correction wire 42 to each of the base 3 and the platform 1. The anchoring member 41 has a leg (not labeled) tightly fit into a hole 14, 31 defined in the wall 12 of the platform 1 and the base 3 whereby the correction wire 42 that is fixed between the anchoring members 41 extends above and through the base 3, the runway 2 and the platform 1 in a manner substantially parallel to the runway 2, serving as an indication of the direction from the base 3 to the circular recess 13 which the golf ball is destined for.

The runway 2 comprises an elongate plate having opposite ends connected to the platform 1 and the base 3. A golf ball (see FIG. 2 but not labeled) is movable along the runway 2 from the end adjacent the base 3 toward the platform 1 and eventually gets into the recess 13. The runway 2 has a thickness at the end adjacent the platform 3 substantially the same as that of the lower end of the incline 11 of the platform 1 connected thereto whereby a smooth way is formed from the runway 2 toward the recess 13.

The correction wire 42 that connects between the base 3 and the platform 1 is resilient for accommodating tolerance therebetween when they are connected by the runway 2.

Figure 3:
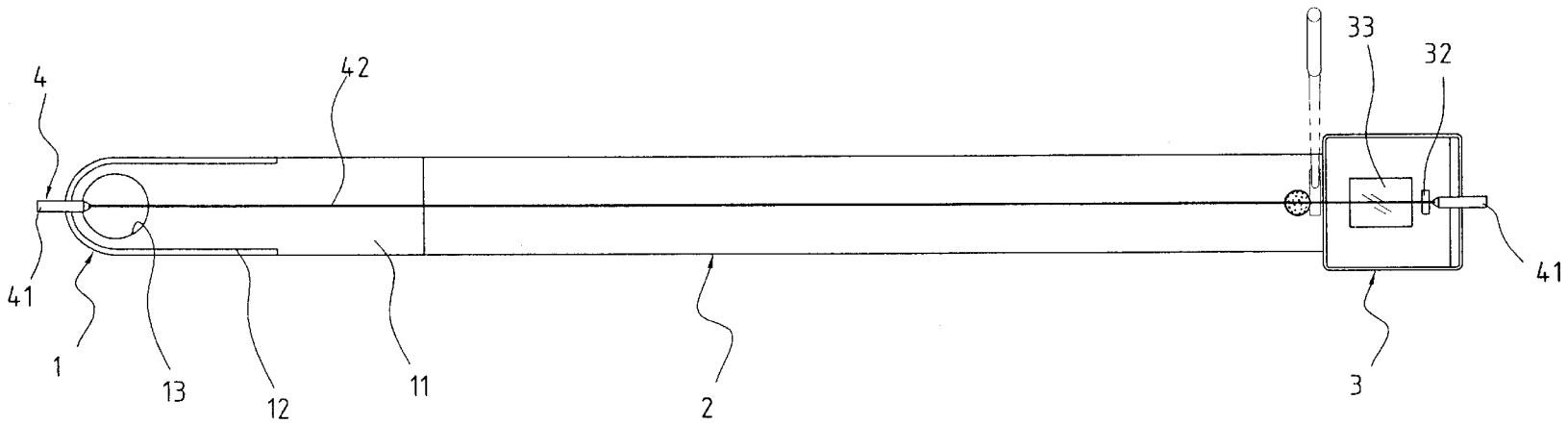
FIG. 3 is a top view of the golf training device of the present invention.
Figure 4:
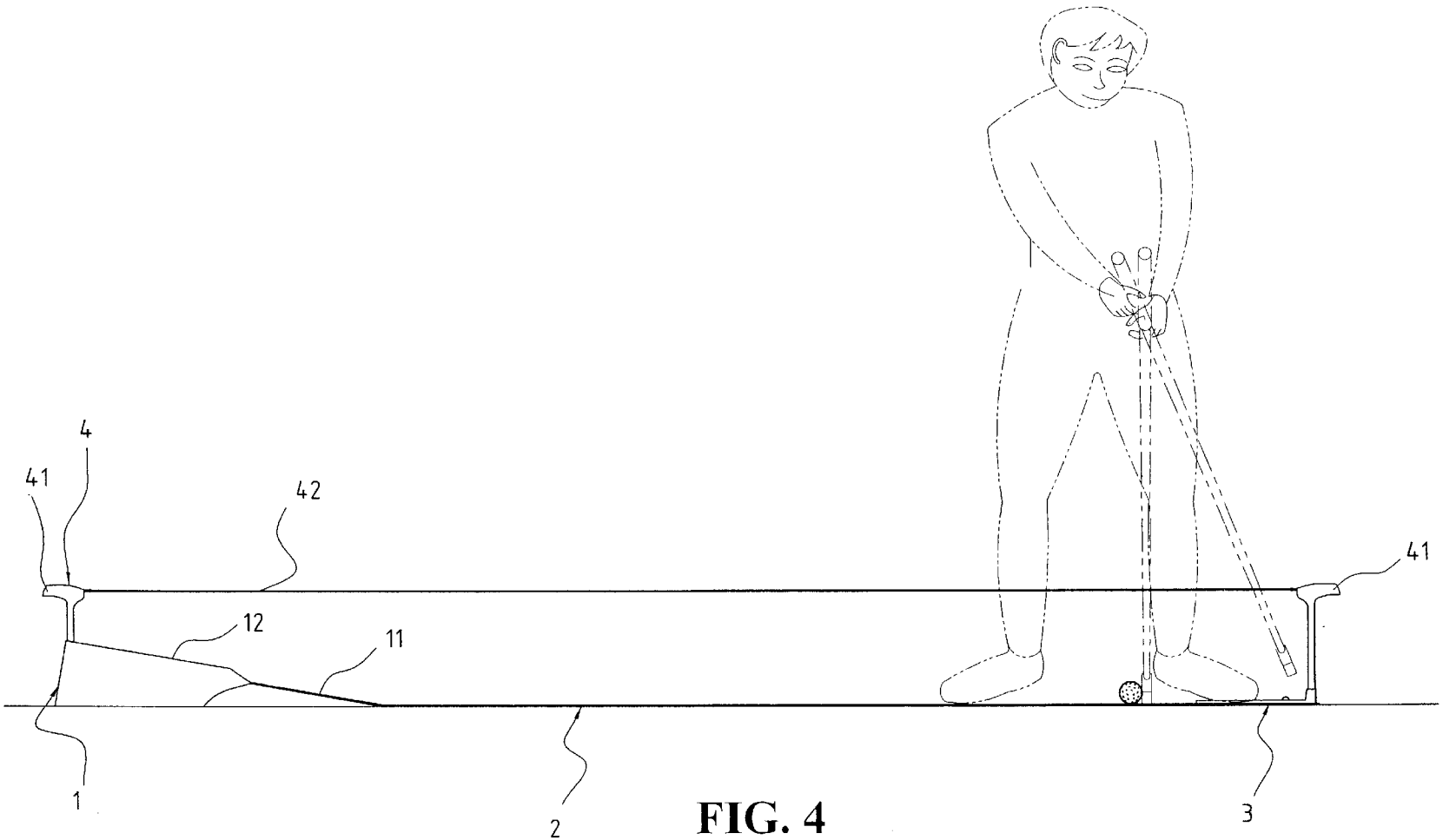
FIG. 4 is a side elevational view of the golf training device of the present invention with a player shown in phantom line putting a ball.

FIGS. 3 and 4 show the operation of the golf training device. A golf ball (not labeled) is placed on the runway 2 adjacent the base 3. The golf ball is positioned substantially midway in the width of the runway 2 (that is the dimension of the runway 2 substantially perpendicular to that between the ends.) A player uses a putter to hit and drive the ball toward the recess 13 of the platform 1 along the runway 2 by following the correction wire 42. Before hitting the ball, the player may correct his or her attitude by observing the correction wire 42 until his or her eyesight, the correction wire 42 and the ball are coincident with each other. By observing the path of the putted ball with reference to the correction wire 42, the player can modify his or her hand holding the putter in order to have the putted ball substantially following the correction wire 42 toward the recess 13 in next hits.

The mirror 33 helps the player to determine if his or her acting in hitting the ball is correct. By repeating putting operation, the player may also find a most suitable way to swing the putter that leads to correct operation of the putter. Observing the mirror allows for the player's memorization of the correct action of playing the putter.

The wall 12 helps to prevent golf balls that are not following a correct path toward the recess 13 from falling out of the platform 1.

Figure 5:
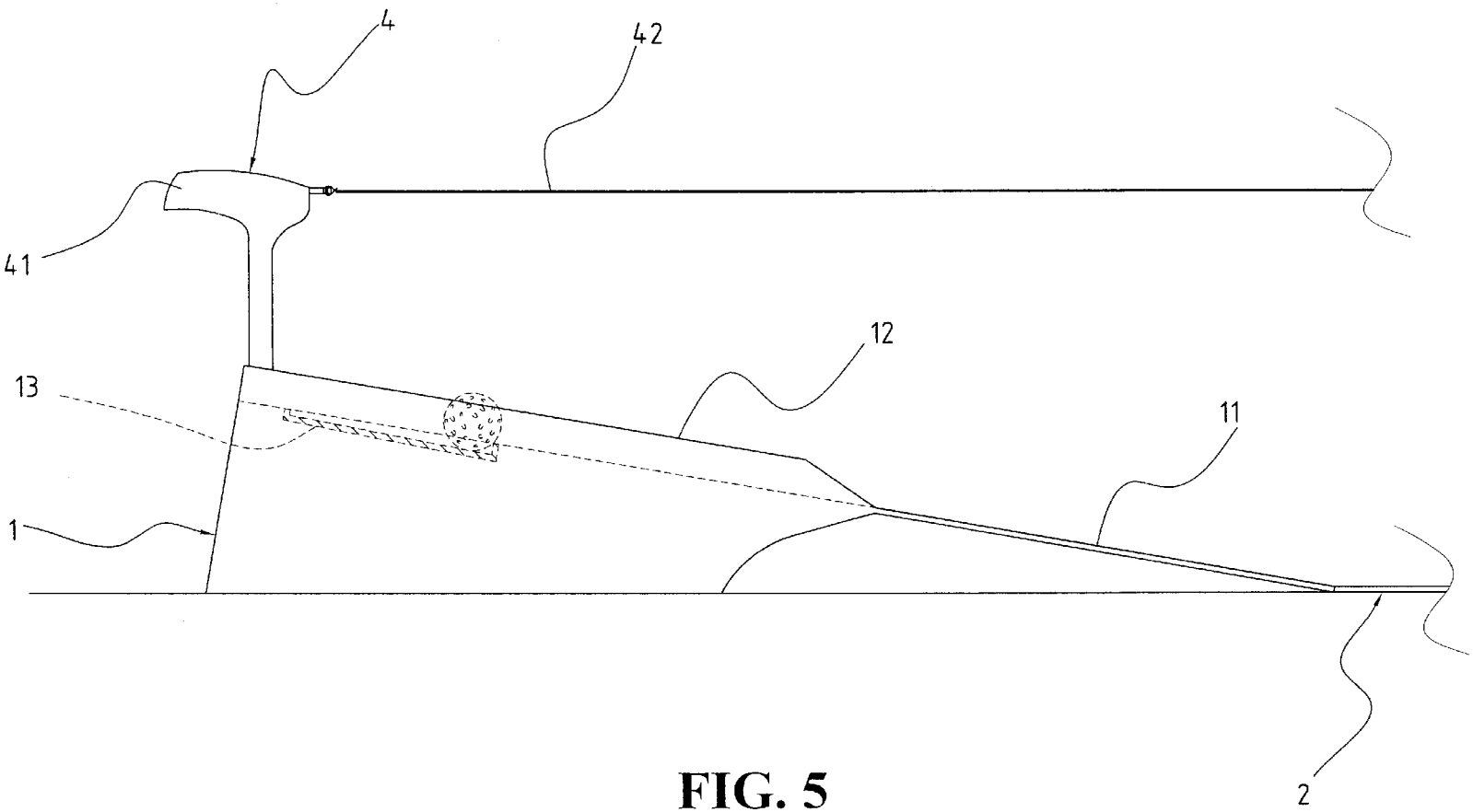
FIG. 5 is a side elevational view of a putting green platform of the golf training device of the present invention.

With reference to FIG. 5, the recess 13 has a depth that is reduced from a large one at an end close to the runway 2 toward a small one at an end away from the runway 2. This, when a first golf ball is already staying in the recess 13, allows the player to hit the first golf ball with a second golf ball. The hit causes the first ball to get out of the recess 13 via the small depth end of the recess 13 and runs back to the base 3 by following the incline 11 of the platform 1, if the hit is properly performed. Practicing such a hit improves the player's skill in putting a golf ball into the recess 13.

Although the present invention has been described with reference to the preferred embodiment thereof, it is apparent to those skilled in the art that a variety of modifications and changes may be made without departing from the scope of the present invention which is intended to be defined by the appended claims.

What is claimed is:

1. A golf training device comprising:

a putting green platform comprising an incline extending from a lower end to an upper end, the incline having a recess, the recess having a varying depth, a first end of the recess being toward the lower end of the incline and the second end of the recess being toward the upper end of the incline, the recess being deeper at the lower end than the upper end so that a ball in the recess hit by a second incoming ball will be movable toward the second end of the recess and then out of the recess to then exit from the lower end of the incline;

a tee base spaced from the putting green platform and having a top surface;

a runway connected between the tee base and the lower end of the incline of the putting green platform; and a correcting device comprising a correction wire located above and extending from the base, through and substantially parallel to the runway, to the platform for forming an indication between the tee base and the recess of the platform.

2. The golf training device as claimed in claim 1, wherein the correction wire is resilient.

3. The golf training device as claimed in claim 1, wherein the correction device comprises two anchoring members respectively fixed to the base and the platform for securing opposite ends of the correction wire.

4. The golf training device as claimed in claim 1, wherein the correction device comprises a mirror attached to the top surface of the tee base.

5. The golf training device as claimed in claim 1, further comprising a level mounted to the top surface of the tee base.

6. The golf training device as claimed in claim 1, wherein the recess is circular.

7. The golf training device as claimed in claim 1, wherein the first end of the recess is closer to the runway than the second end of the recess.

8. A golf training device comprising:

a putting green platform having an incline extending from a lower end to an upper end;

a tee base spaced from the putting green platform and having a top surface;

a runway connecting the tee base and the lower end of the incline of the putting green platform;

means for returning a ball from the incline to an area adjacent the tee base, the means for returning including a recess formed on the incline, the recess having a first end and a second end, the first end having a depth greater than the second end, a first ball being received in the recess being strikable by a second ball and thereafter being movable from the first end, past the second end and out of the recess onto the incline where the first ball will roll from the incline, back along the runway toward the tee base; and a correction device having a correction wire located above and extending from the base, though and substantially parallel to the runway, to the platform for forming an indication between the tee base and the recess of the means for returning.

9. The golf training device as claimed in claim 8, further comprising a wall surrounding the incline of the platform.

10. The golf training device as claimed in claim 8, wherein the correction wire is resilient.

11. The golf training device as claimed in claim 8, wherein the correction device comprises two anchoring members respectively fixed to the base and the platform for securing opposite ends of the correction wire.

12. The golf training device as claimed in claim 8, wherein the correction device comprises a mirror attached to the top surface of the tee base.

13. The golf training device as claimed in claim 8, further comprising a level mounted to the top surface of the tee base.

14. The golf training device as claimed in claim 8, wherein the recess of the means for returning is circular.

15. The golf training device as claimed in claim 8, wherein the first end of the recess is closer to the runway than the second end of the recess.

16. The golf training device as claimed in claim 8, further comprising a wall surrounding the incline of the platform.

* * * * *